United States Patent [19]

Fuchs, Jr.

[11] 4,050,279

[45] Sept. 27, 1977

[54] APPARATUS AND METHODS FOR FORMING AN ELONGATED PRODUCT

[75] Inventor: Francis Joseph Fuchs, Jr., Princeton Junction, N.J.

[73] Assignee: Western Electric Company, Inc., New York, N.Y.

[21] Appl. No.: 704,873

[22] Filed: July 13, 1976

[51] Int. Cl.[2] ..... B21C 25/02

[52] U.S. Cl. ..... 72/261; 72/468

[58] Field of Search ..... 72/261, 467, 468; 425/464

[56] References Cited

U.S. PATENT DOCUMENTS

| | | | |
|---|---|---|---|
| 2,408,627 | 10/1946 | Green | 72/467 |
| 2,660,302 | 11/1953 | Gersman | 72/467 |
| 3,008,187 | 11/1961 | Slade | 72/467 |
| 3,113,676 | 12/1963 | Harkenrider | 72/270 |
| 3,765,222 | 10/1973 | Lundback | 72/467 |
| 3,973,428 | 8/1976 | Lugosi | 72/467 |

*Primary Examiner*—Lowell A. Larson
*Attorney, Agent, or Firm*—A. S. Rosen

[57] ABSTRACT

Apparatus for deforming a workpiece so as to produce an elongated product, which product may be composed of one or more articles and has an overall cross-sectional shape differing from that of the workpiece, includes a specially configured extrusion die. The die provides a wall surface which converges toward an entrance end of one or more die apertures, the wall surface having a shape selected to build up pressure smoothly and substantially uniformly within the material of the workpiece as the workpiece is forced against the wall surface, such that substantially all of the material of the workpiece first attains the overall cross-sectional shape of the product in substantially the same cross-sectional plane of the die at the entrance end of the die aperture or apertures, and such that redundant work is minimized. Examples of such a die, and an exemplary method of extrusion to form such a product, are also disclosed.

13 Claims, 4 Drawing Figures

FIG. 1
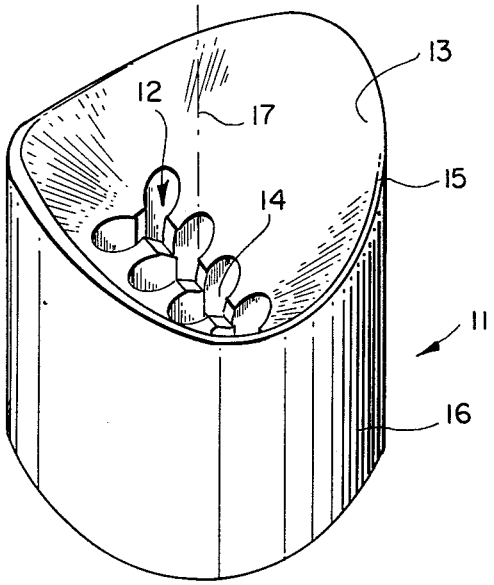
FIG. 2
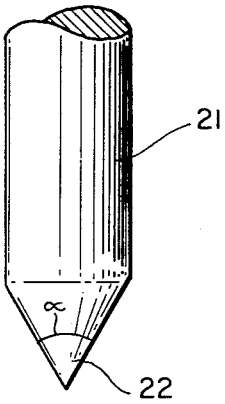
FIG. 3
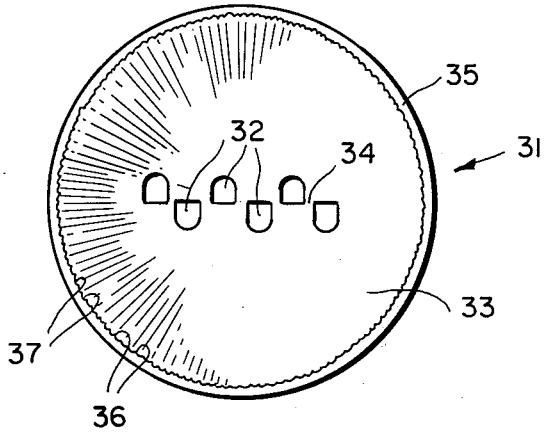
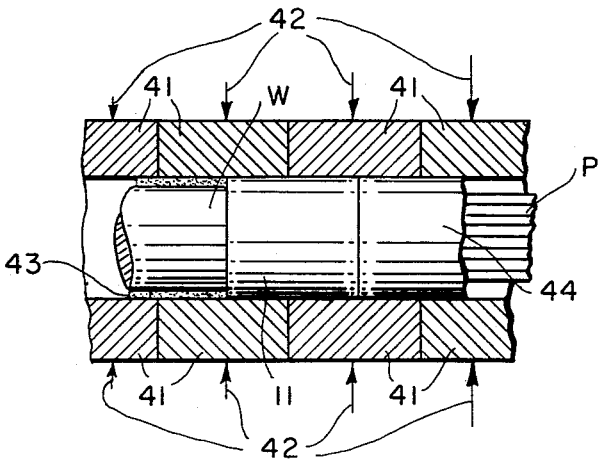
FIG. 4

APPARATUS AND METHODS FOR FORMING AN ELONGATED PRODUCT

BACKGROUND OF THE INVENTION

1. Field of the Invention

This invention relates to apparatus and methods for forming an elongated product and, more particularly, to apparatus and methods for deforming a workpiece so as to produce an elongated product, which product may be composed of one or more individual elongated articles, where the overall cross-sectional shape of the product differs from that of the workpiece.

2. Description of the Prior Art

In the art of forming elongated products, it is known to utilize hydrostatic extrusion techniques, wherein hydrostatic pressure is applied to a workpiece within a chamber such that the material of the workpiece is rendered more ductile as the billet is forced through an aperture in a die located at one end of the chamber. Some examples of such techniques may be found in my U.S. Pat. No. Re. 28,795, in my copending application, Ser. No. 612,875, filed Sept. 12, 1975, and entitled, "Continuous Extrusion", and in my copending application, Ser. No. 664,611, filed Mar. 8, 1976, and entitled "Apparatus and Methods for Continuous Extrusion".

It is also known in such art to provide apparatus which includes a die having a plurality of apertures extending therethrough, and to force a workpiece through such die, e.g., by the hydrostatic extrusion techniques disclosed in my previously mentioned patent and applications, so as to produce simultaneously a plurality of elongated articles. For example, one such die is disclosed in my U.S. Pat. No. 3,948,079. Other such dies are disclosed in my copending applications entitled, "Apparatus and Methods for Forming Multiple Elongated Products" (Ser. No. 638,493) and "Apparatus and Methods for Forming a Plurality of Elongated Products" (Ser. No. 638,495), both filed on Dec. 8, 1975.

In my copending application, Ser. No. 638,494, also filed on Dec. 8, 1975, and entitled, "Methods and Apparatus for Forming and Handling Elongated Products", I teach the use of a suitably shaped die for deforming a workpiece, e.g., by the previously described hydrostatic extrusion techniques, in order to produce an integral structure, such as a tape, composed of the material of the workpiece. Such integral structure includes a number of elongated articles extending in parallel plus additional interconnecting material joining the elongated articles together into a single elongated product for simplified handling, prior to dissociation into individual elongated articles. Additionally, in my copending application, Ser. No. 670,467, filed Mar. 25, 1976 and entitled, "Methods and Apparatus for Forming Wire Tapes", I disclose alternative techniques for forming such a tape.

In many instances, the overall cross-sectional shape of the product of an extrusion process, whether such product be a single article or a number of simultaneously formed articles, differs from the initial cross-sectional shape of the workpiece. Such difference in shape is characteristic, for example, of my previously mentioned applications, Ser. Nos. 638,493, 638,494, and 638,495, all of which were filed on Dec. 8, 1975, and Ser. No. 670,467, filed Mar. 25, 1976. The use of conventional types of extrusion dies, having tapering entry walls of conical shape, leading to appropriately configured apertures cut through the die centers, has not proved particularly satisfactory where such changes in shape during extrusion have been involved. It has been noted, for example, that the extrusion pressures required have generally been higher in such cases than in the case of round-to-round extrusions at equivalent reduction ratios with similar tapering die entry walls of conical shape. Such increased pressure levels are believed to result from the fact that, as the cross-section of a workpiece undergoes reshaping during extrusion, the material at the radially outermost edges of the workpiece tends to attain its final size sooner than does the material toward the center of the workpiece. Thus, as the more central material continues to undergo plastic deformation, the resulting internal pressure in the workpiece causes the radially outermost edge material to swell outwardly against the die aperture boundary surfaces, causing additional frictional drag.

U.S. Pat. No. 3,583,204 to J. Nilsson discloses a die for forming a product having a cross-sectional shape which differs from that of a workpiece employed, which die does not utilize the conventional conical entry wall configuration. Instead, a conical first part tapers inwardly, at a 45° apex angle, into a chisel-shaped second part, with a 90° apex angle, leading to an aperture of rectangular configuration. The previously discussed, premature attainment of final size along the radially outermost edges of the workpiece, is apparently characteristic also of the Nilsson die. Moreover, a degree of redundant work is believed introduced by the configuration of the Nilsson die, by virtue of the two part arrangement. In particular, since each element of the material of the workpiece is twice redirected prior to reaching the rectangular die aperture, i.e., once upon entering into the 45° conical first part and once upon entering into the 90° chisel-shaped second part, the work involved in changing direction of the workpiece element is greater than that required by a direct, straight line flow of workpiece material along a die entry wall. Thus, the use of the Nilsson die apparently requires relatively high operating pressures.

Accordingly, there is a clear need for apparatus and methods wherein relatively low operating pressures are required in order to deform a workpiece into a product, composed of one or more individual articles, with an overall cross-sectional shape differing from that of the workpiece.

SUMMARY OF THE INVENTION

The invention contemplates the deforming of a workpiece into a product, composed of one or more individual articles, with an overall cross-sectional shape differing from that of the workpiece, by forcing the workpiece through a specially shaped die. The die has aperture means extending through its body, the aperture means including at least one aperture and providing an overall aperture configuration which corresponds to the overall cross-sectional shape of the product to be formed. The die also includes wall means which converge toward an entrance end of the aperture means, the wall means having a shape selected to build up pressure smoothly and substantially uniformly within the material of the workpiece as the workpiece is forced against the wall means, such that substantially all of the material of the workpiece first attains the overall cross-sectional shape of the product in substantially the same cross-sectional plane of the die at the entrance end of the aperture means. The shape of the die wall means is also designed to minimize redundant work in reshaping the workpiece material.

Various embodiments of the invention each utilize a die which takes the form of a die body having aperture means extending axially therethrough about a central axis of the aperture means, with the aperture means including at least one aperture and providing an overall aperture configuration corresponding to the overall cross-sectional shape of the product to be formed, and with the aperture means having a maximum transverse dimension in a direction perpendicular to the central axis of the aperture means. In each such embodiment, the die includes wall means which converge toward an entrance end of the aperture means In a first embodiment, the die wall means has a surface generated by the operation of a tool, with a generally conical tip, upon a die blank in the form of a cylinder, e.g., a right-circular cylinder with a diameter greater than the maximum transverse dimension of the aperture means. The aperture means is first cut through the cylindrical die blank, centered on the axis of the cylinder, by any other appropriate tool. The conically tipped tool is then employed to trace the maximum transverse dimension of the aperture means across one face of the cylinder, thereby forming the die wall means.

In a second and generally similar embodiment, the die wall means has a surface which is generated by means of a similar, conically tipped tool and a similar, cylindrical die blank. Instead of tracing the maximum transverse dimension of the aperture means, however, the tip of the tool is caused to trace the periphery of the aperture means.

In a third embodiment, the die wall means has a surface which is bounded by the entrance end of the aperture means and by a closed curve, e.g., a circle, substantially centered on the central axis of the aperture means and displaced axially from the aperture means, the boundary circle having a diameter greater than the maximum transverse dimension of the aperture means. Such surface of the wall means has a shape defined substantially by a number of ridges and a like number of relatively recessed areas. The ridges interconnect selected arcuate divisions about the periphery of the boundary circle with corresponding peripheral divisions about the entrance end of the aperture means. The recessed areas extend between the boundary circle and the entrance end of the aperture means intermediate adjacent ones of the ridges, the recessed areas serving to direct various elements of the workpiece being forced through the die toward respective corresponding peripheral divisions about the entrance end of the aperture means.

BRIEF DESCRIPTION OF THE DRAWING

FIG. 1 of the drawing is an isometric view of a die which may be utilized in accordance wih the principles of the invention in apparatus for deforming a workpiece so as to produce an elongated product, composed of a single elongated article, where the cross-sectional shape of the single elongated article differs from that of the workpiece;

FIG. 2 is a side elevational view of a tool which may be used in forming the die of FIG. 1;

FIG. 3 is a plan view of alternative die, which may be utilized in place of the die of FIG. 1, and which is adapted to deform a workpiece so as to produce an elongated product, comprising several individual elongated articles, where the overall cross-sectional shape of the elongated product differs from that of the workpiece; and FIG. 4 is a longitudinal view, partly in section, of portions of apparatus which may utilize a die, such as that of FIG. 1 or that of FIG. 3, in order to deform a workpiece so as to produce an elongated product, composed of one or more individual elongated articles, where the overall cross-sectional shape of the product differs from that of the workpiece.

DETAILED DESCRIPTION

Referring initially to FIG. 1 of the drawing, a die 11 includes an aperture 12 of complex shape, useful in deforming a workpiece so as to produce an elongated tape of the type disclosed in my previously mentioned copending application, Ser. No. 638,494, filed Dec. 8, 1975. The die 11 further includes a wall surface 13, also of complex shape, which coverges toward an entrance end 14 of the aperture 12 from an irregular peripheral rim 15 of the die 11. The aperture 12 extends axially through the die 11 from the entrance end 14, adjacent to the wall surface 13, to an exit end (not shown) of the aperture 12.

The complex shape of the wall surface 13 is particularly selected in order that, upon the extrusion through the die 11 of a workpiece having a cross-section of a shape which differs from that of the aperture 12, e.g., a workpiece of circular cross-section, pressure will be built up smoothly and substantially uniformly within the material of the workpiece as the workpiece is forced against the wall surface 13, with substantially all of the material of the workpiece first attaining the shape of the aperture 12 in substantially the same cross-sectional plane of the die 11 at the entrance end 14 of the aperture 12. The shape of the wall surface 13 is also designed to minimize redundant work in reshaping the workpiece material. In particular, the wall surface 13 has a configuration generated by the operation of a tool, which will hereafter be described, upon a die blank in the form of a cylinder 16, e.g., a right-circular cylinder. The cylinder 16 has a diameter greater than a maximum transverse dimension spanned by the aperture 12, i.e., the largest diameter of the aperture 12, in order to surround the entire aperture 12, and has an axis which substantially coincides with a central axis 17 of the die 11.

A suitable tool 21 for generating complex shape of the wall surface 13 is shown in FIG. 2 of the drawing. The tool 21 has a conical tip 22 which tapers at an apex angle $\alpha$ of, for example, from about 40° to about 90°. Once the aperture 12 has been cut into the cylindrical blank 16 for the die 11 by any other appropriate tool, the wall surface 13 may be formed by simply substantially tracing the previously described maximum transverse dimension of the aperture 12 at its entrance end 14 with the tool 21, the tool preferably being rotated about its axis, and/or being employed as an electrical discharge machining tool, while maintained parallel to the central axis 17 of the die 11 as the wall surface 13 is machined. The shape of the peripheral rim 15 of the die 12 is, thus, that formed by the intersection of the edges of the conical tip 22 of the tool 21 with the outer surface of the cylinder 16 as the tool 21 traces the maximum transverse dimension of the aperture 12.

During the extrusion of a workpiece through the die 11 formed by the machining operation just described, a typical element of the workpiece material will initially contact the wall surface 13 while moving in a direction parallel to the central axis 17 of the die 11. Each such workpiece element will thereupon travel along the wall surface 13 toward the entrance end 14 of the aperture 12 at a like angle, equal to one-half of the angle $\alpha$, thereby minimizing redundant work in reshaping the workpiece material. Moreover, inasmuch as the span across the aperture 12, perpendicular to the maximum transverse dimension, will ordinarily be quite small relative to the diameter of the cylinder 16, the entrance end 14 of the aperture 12 will be largely planar. Thus, substantially all of the material of a workpiece forced through the die 11 will attain its final shape in substantially the same plane at the entrance end 14 of the aperture 12.

Alternatively, the tool 21 may be moved across the surface of the previously described die blank adjacent to the entrance end 14 of the aperture 12 so as to trace the periphery of the aperture 12. Such alternative technique of forming the wall surface 13, although necessitating a slightly more difficult forming operation, provides a wall surface configuration wherein the entrance end 14 of the aperture 12 is completely planar, at least to the degree of accuracy of which the machining operation is capable.

It should be clear that the shape of the aperture 12 in the die 11 is exemplary only. Other aperture configurations are equally appropriate, e.g., an aperture shaped to produce an elongated tape of the type disclosed in my previously mentioned copending application, Ser. No. 670,467, filed Mar. 25, 1976. Alternatively, a plural aperture arrangement, such as that shown in FIG. 3 of the drawing and next to be described, might be utilized, it being appropriate, however, that the overall cross-sectional shape of the elongated product to be formed be different from that of the workpiece which is to be employed.

Turning now to FIG. 3, an alternative die 31 includes a number of individual apertures 32 which extend axially through the die 31. The die 31 includes a wall surface 33, of complex shape, which converges toward an entrance end 34 of the group of apertures 32, from a peripheral rim 35 of the die 31.

The complex shape of the wall surface 33 of the alternative die 31 is particularly selected to produce a similar result to that provided by the shape selected for the wall surface 13 of the die 11. Thus, upon the extrusion through the die 31 of a workpiece having a cross-section of a shape which differs from the overall shape of the group of apertures 32, e.g., a workpiece of circular cross-section, pressure will build up smoothly and substantially uniformly within the material of the workpiece as the workpiece is forced against the wall surface 33, with substantially all of the material of the workpiece first attaining the overall shape of the group of apertures 32 in substantially the same cross-sectional plane of the die 31 at the entrance end 34 of the group of apertures 32, while redundant work in reshaping the workpiece is minimized. In particular, the wall surface 33 is bounded by the entrance end 34, and by the peripheral rim 35 which constitutes a closed curve, e.g., a circle, substantially centered on a central axis of the group of apertures 32 and displaced axially from the group of apertures 32, with a diameter greater than a maximum transverse dimension, i.e., a maximum diameter, spanned by the group of apertures 32. The wall surface 33 has a shape defined substantially by a number of ridges 36 and a like number of relatively recessed areas or grooves 37. The ridges 36 interconnect selected, and preferably equal, arcuate divisions about the peripheral rim 35 with corresponding peripheral divisions about the entrance end 34 of the group of apertures 32. The grooves 37 extend between the peripheral rim 35 and the entrance end 34 of the group of apertures 32 intermediate the ridges 36. The grooves 37 serve to direct various elements of a workpiece passing through the die 31 toward respective corresponding peripheral divisions about the entrance end 34 of the group of apertures 32 so as to provide a substantially uniform flow of workpiece material to the various apertures 32 of the group during extrusion, with the material of all such workpiece elements flowing generally inwardly toward a central axis of the group of apertures 32 continuously, from an initial contact with the wall surface 33 until reaching the plane of the entrance end 34 of the group of apertures 32.

The grooves 37 may be formed in the wall surface 33 of a blank for the die 31, after the cutting of the group of apertures 32 through such blank, using a tip portion of any suitable tool (not shown). A spacing between adjacent grooves 37, along the peripheral rim 35, of about 10 mils is appropriate. After the forming of the grooves 37, the wall surface 33 may be lightly polished, preferably leaving the structure of the ridges 36 and the grooves 37 substantially unaltered.

It should be clear, once again, that the shape of the group of apertures 32 in the die 31 is exemplary only. Other plural aperture configurations are equally appropriate. Alternatively, a single aperture arrangement, such as that shown in FIG. 1 of the drawing and previously described, might be utilized, it being appropriate, however, that the cross-sectional shape of such single aperture be different from that of the workpiece which is to be employed.

Referring next to FIG. 4 of the drawing, there are illustrated pertinent portions of a preferred apparatus for utilizing an appropriate die, constructed in accordance with the principles of the invention, such as the die 11, to deform a workpiece W into a product P with an overall cross-sectional shape differing from that of the workpiece. This apparatus is more fully described in my previously mentioned copending application, Ser. No. 612,875, filed Sept. 12, 1975. The apparatus includes a number of gripping element sectors 41 which are advanced from left to right as illustrated in FIG. 4. As the sectors 41 advance toward the right, they are subjected to a continually increasing compressive pressure, as indicated by arrows 42 which increase in size from left to right.

The workpiece W has its outer periphery coated with a lubricating, shear transmitting medium 43, e.g., polyethylene wax. Shear stresses transmitted through the medium 43 serve to advance the workpiece W from left to right in FIG. 4 with the advancing sectors 41. At the same time, compressive stresses of continually increasing magnitude are also imposed upon the advancing workpiece W, thereby rendering the workpiece W considerably more ductile and more suited to extrusion. Such extrusion takes place, with the workpiece W rendered suitably ductile by the compressive pressures exerted upon it, as the workpiece W is forced against the die 11 and through its aperture 12, by shear forces in the medium 43, so as to form the product P. The die 11, which is carried on a suitable die stem 44, may, of course, be replaced by any other suitable die structure constructed in accordance with the principles of the invention, e.g., the die 31 depicted in FIG. 3 of the drawing.

It is to be understood that the described methods and apparatus are simply illustrative of preferred embodiments of the invention. Many modifications may be made in accordance with the principles of the invention.

What is claimed is:

1. Apparatus for deforming a workpiece so as to form a product composed of one or more substantially adjacent, individual articles, the product having an overall cross-sectional shape which differs from that of the workpiece, said apparatus comprising:

a die having aperture means extending therethrough, said aperture means having an entrance end and including at least one aperture, with said aperture means providing an overall aperture configuration which differs from that of the workpiece and corresponds to said overall cross-sectional shape of the product to be formed, said die also including wall means which converge from an outer periphery of the die toward said entrance end of the aperture means, with each element of the surface of said wall means so converging continuously, along a single linear, substantially radially directed path, and with said elements generally defining a continuous, substantially smoothly flowing surface from element to adjacent element surrounding said entrance end of the aperture means, so as to build up pressure smoothly and continuously within the material of the workpiece as the workpiece is forced against the wall means, the surface of the wall means being further configured such that substantially all of the material of the workpiece first attains said overall cross-sectional shape of the product in substantially the same cross-sectional plane of the die at said entrance end of the aperture means; and means for forcing the workpiece against said wall means with sufficient pressure to force the workpiece through said aperture means so as to form said product.

2. Apparatus as set forth in claim 1, wherein said die comprises:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface, intersecting said outer periphery of the die body, which corresponds substantially to the shape formed by tracing, with a tool having a conical tip, said maximum transverse dimension of the aperture means in the die body at said entrance end thereof.

3. Apparatus as set forth in claim 1, wherein said die comprises:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface, intersecting said outer periphery of the die body, which corresponds substantially to the shape formed by tracing, with a tool having a conical tip, the periphery of the aperture means in the die body at said entrance end thereof.

4. Apparatus as set forth in claim 1, wherein said die comprises:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface bounded by the entrance end of said aperture means, and by a closed curve substantially centered on said central axis and displaced axially, and radially outwardly, from the aperture means, said closed curve following said outer periphery of the die body, said surface having a shape defined substantially by a number of ridges linearly interconnecting selected arcuate divisions about the periphery of the closed curve with corresponding peripheral divisions about the entrance end of the aperture means, and by relatively recessed areas between the closed curve and the entrance end of the aperture means intermediate adjacent ones of said ridges, said recessed areas serving to direct various elements of the workpiece forced through the die linearly toward respective corresponding peripheral divisions about the entrance end of the aperture means.

5. Apparatus as set forth in claim 1, wherein said die comprises:

a die body having aperture means extending axially therethrough, said aperture means comprising a single aperture.

6. Apparatus as set forth in claim 1, wherein said die comprises:

a die body having aperture means extending axially, therethrough, said aperture means comprising a plurality of substantially adjacent apertures.

7. A die for deforming a workpiece so as to form a product composed of one or more substantially adjacent, individual articles, the product having a cross-sectional shape which differs from that of the workpiece, said die comprising:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface, intersecting said outer periphery of the die body, which corresponds substantially to the shape formed by tracing, with a tool having a conical tip, said maximum transverse dimension of the aperture means in the die body at said entrance end thereof.

8. A die for deforming a workpiece so as to form a product composed of one or more substantially adjacent, individual articles, the product having a cross-sectional shape which differs from that of the workpiece, said die comprising:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface, intersecting said outer periphery of the die body, which corresponds substantially to the shape formed by tracing, with a tool having a conical tip, the periphery of the aperture means in the die body at said entrance end thereof.

9. A die for deforming a workpiece so as to form a product composed of one or more substantially adjacent, individual articles, the product having a cross-sectional shape which differs from that of the workpiece, said die comprising:

a die body having aperture means extending axially therethrough about a central axis of the aperture means, said aperture means having an entrance end and including at least one aperture, with the aperture means providing an overall aperture configuration corresponding to said overall cross-sectional shape of the product to be formed, and with the aperture means having a maximum transverse dimension, smaller than a corresponding dimension of the die body, in a direction perpendicular to said central axis; and wall means which converge from an outer periphery of the die body toward said entrance end of the aperture means, said wall means having a surface bounded by the entrance end of said aperture means, and by a closed curve substantially centered on said central axis and displaced axially, and radially outwardly, from the aperture means, said closed curve following said outer surface of the die body, said surface having a shape defined substantially by a number of ridges linerarly interconnected selected arcuate divisions about the periphery of the closed curve with corresponding peripheral divisions about the entrance end of the aperture means, and by relatively recessed areas between the closed curve and the entrance end of the aperture means intermediate adjacent ones of said ridges, said recessed areas serving to direct various elements of the workpiece forced through the die linearly toward respective corresponding peripheral divisions about the entrance end of the aperture means.

10. A method of deforming a workpiece so as to form a product composed of one or more individual articles, the product having an overall cross-sectional shape which differs from that of the workpiece, said method comprising:

forcing the workpiece against the wall means of the die of claim 7 with sufficient pressure to force the workpiece through the aperture means of said die so as to form said product.

11. A method of deforming a workpiece so as to form a product composed of one or more individual articles, the product having an overall cross-sectional shape which differs from that of the workpiece, said method comprising:

forcing the workpiece against the wall means of the die of claim 8 with sufficient pressure to force the workpiece through the aperture means of said die so as to form said product.

12. A method of deforming a workpiece so as to form a product composed of one or more individual articles, the product having an overall cross-sectional shape which differs from that of the workpiece, said method comprising:

forcing the workpiece against the wall means of the die of claim 9 with sufficient pressure to force the workpiece through the aperture means of said die so as to form said product.

13. A method of deforming a workpiece so as to form a product composed of one or more substantially adjacent, individual articles, the product having an overall cross-sectional shape which differs from that of the workpiece, said method comprising:

a. aligning the workpiece with an axis of a die having aperture means extending axially therethrough from an entrance end of the aperture means, the aperture means including at least one aperture and providing an overall aperture configuration which differs from that of the workpiece and corresponds to the overall cross-sectional shape of the product to be formed; and b. forcing the workpiece axially against said die and through said aperture means; while c. building up pressure smoothly and continuously within the material of the workpiece by causing each surface element of the workpiece to move along a single continuous, linear path, directed substantially radially and axially inwardly, as the workpiece is forced against said die and into said entrance end of the aperture means, and simultaneously causing said surface elements to follow a continuous, substantially smoothly flowing surface pattern from element to adjacent element surrounding the entrance end of the aperture means; and while d. causing substantially all of the material of the workpiece first to attain said overall cross-sectional shape of the product in substantially the same cross-sectional plane of the die at the entrance end of the aperture means.

* * * * *